US006183247B1

(12) United States Patent
Lindberg

(10) Patent No.: US 6,183,247 B1
(45) Date of Patent: Feb. 6, 2001

(54) HEATING EQUIPMENT

(75) Inventor: Sven Lindberg, Degerfors (SE)

(73) Assignee: SL Varmeekonomi, Degerfors (SE)

( * ) Notice: Under 35 U.S.C. 154(b), the term of this patent shall be extended for 0 days.

(21) Appl. No.: 09/423,307

(22) PCT Filed: Mar. 12, 1998

(86) PCT No.: PCT/SE98/00446

§ 371 Date: Nov. 12, 1999

§ 102(e) Date: Nov. 12, 1999

(87) PCT Pub. No.: WO98/51965

PCT Pub. Date: Nov. 19, 1998

(30) Foreign Application Priority Data

May 14, 1997 (SE) ..... 9701775

(51) Int. Cl.[7] ..... F27B 15/04
(52) U.S. Cl. ..... 432/215; 432/206
(58) Field of Search ..... 432/93, 156, 158, 432/197, 206, 214, 215, 217

(56) References Cited

U.S. PATENT DOCUMENTS

| | | | | |
|---|---|---|---|---|
| 2,740,619 | * | 4/1956 | Lynch | 432/215 |
| 2,751,211 | * | 6/1956 | Begley | 432/215 |
| 3,248,206 | * | 4/1966 | Apple et al. | 432/156 |
| 4,069,107 | * | 1/1978 | Koppelman et al. | 432/215 |
| 5,522,156 | * | 6/1996 | Ware | 34/356 |

* cited by examiner

*Primary Examiner*—Denise L. Ferensić
*Assistant Examiner*—Gregory A. Wilson
(74) *Attorney, Agent, or Firm*—Dennison, Scheiner. Schultz & Wakeman

(57) ABSTRACT

A heating device for burning fuel pellets (2) having a spherical combustion area (7), the surrounding wall of which is perforated (37), is disclosed. The combustion area (7) is surrounded concentrically by a wall(40) having perforations (36) and is spaced from the wall (10) of the combustion chamber. The space between the two walls (10 and 40) is utilized to hold the fuel pellets which are ignited by a heated medium directed from the outside towards both the walls (10 and 40).

19 Claims, 8 Drawing Sheets

HEATING EQUIPMENT

FIELD OF THE INVENTION

The present invention relates to heating equipment allowing the use of particle shaped fuel of various materials such as pellets produced from starting materials of wood and the like.

BACKGROUND OF THE INVENTION

Several such types of equipment are known and the present invention aims at using an arrangement for burning brushwood waste. Two cylindrical units are used here, arranged concentrically so that a core area and an annular space are formed. Both the wails forming said unit are perforated and the annular space is filled with brushwood waste which is fed into the space from below. The brushwood waste is ignited and combustion is maintained by air being allowed to flow through perforations in the two pipes. This known arrangement provided the impulse to develop a completely new type of heating equipment for burning pellets.

SUMMARY OF THE INVENTION

The present invention has a central body with a flame outlet, the central body having coherent walls and being closed except for the flame outlet. The wall of the central unit is perforated. A wall is arranged concentrically outside said central unit and spaced from the wall of the central unit so that a space is formed, the outer walls of said space also being perforated. The space is filled with pellets and both units are subjected to medium directed towards the core unit. Initially the medium has elevated temperature so that the fuel is ignited. Once this has occurred the temperature of the medium supplied is reduced. Fuel is gradually supplied to the space around the central unit by a dosing device. The central unit and its surrounding outer wall can rotate about its axis when only one directed air jet is used. It is obvious that said air jet can be supplied to the central unit in a number of different ways and that rotation can thus be avoided. One way of avoiding rotation is for the outer wall to be surrounded by annular pipes, these pipes being arranged in rings around the outer wall and following each other so that substantially the entire outer wall is covered by pipes lying one on top of the other, each pipe also communicating with a perforation inside the wall. Each pipe is connected to a unit for supplying medium. The space for pellets, the outer wall of which is perforated, can cooperate with a closed wall situated outside the perforated wall of the pellet space and, together with this wall, forms a closed space with the exception of an inlet for medium. By means of transverse walls spaced from each other, the closed space can form a number of pipes situates one above the other and having substantially rectangular cross section, said pipes having a perforated wall. This rotation can be avoided if the outer wall is surrounded by annular pipes. These pipes are arranged as rings around the outer wall. The pipes are arranged one after the other so that substantially the entire outer wall is covered by pipes lying one on top of the other. Each pipe also communicates with a perforation inside the wall. Each pipe is connected to a unit for supplying medium. The supply of medium is controlled by means of a distributing unit connected to a fan. Said fan is also connected to a fuel-supply channel so that medium can be supplied to the central space via a valve in the transport channel. A number of openings are arranged around the edge of the flame outlet, said openings being connected to a fan which supplies medium to return uncombusted particles to the combustion chamber. The flame outlet is in communication with a container transferring heat from the flame to a heat-absorbing medium such as water, arranged in a container. This container may be connected, for instance, to various units which conduct the heat further to a heating system in which the heat is waterborne, for instance. The space transferring heat to the heat-absorbing medium is in communication with a flue-gas outlet such as a chimney.

For said heating equipment to function optimally a control unit is required which communicates with the chimney, with a dosing device, with both fans, with the distributing unit, and with a valve arranged on the central unit, said valve also acting as distributing means for fuel. A device is also connected to the control unit which reacts when the fuel is ignited and a device to indicate the temperature of the heat-absorbing medium.

All units in the equipment which are subjected to high temperatures shall be made of materials resistant to said high temperatures and a suitable material may be ceramic material or the like.

BRIEF DESCRIPTION OF THE DRAWINGS

Additional characteristics of the present invention are revealed in the following description and the appended claims. The invention will be described in more detail with reference to the accompanying drawings in which

DETAILED DESCRIPTION OF THE PREFERRED EMBODIMENT

Figure 1:
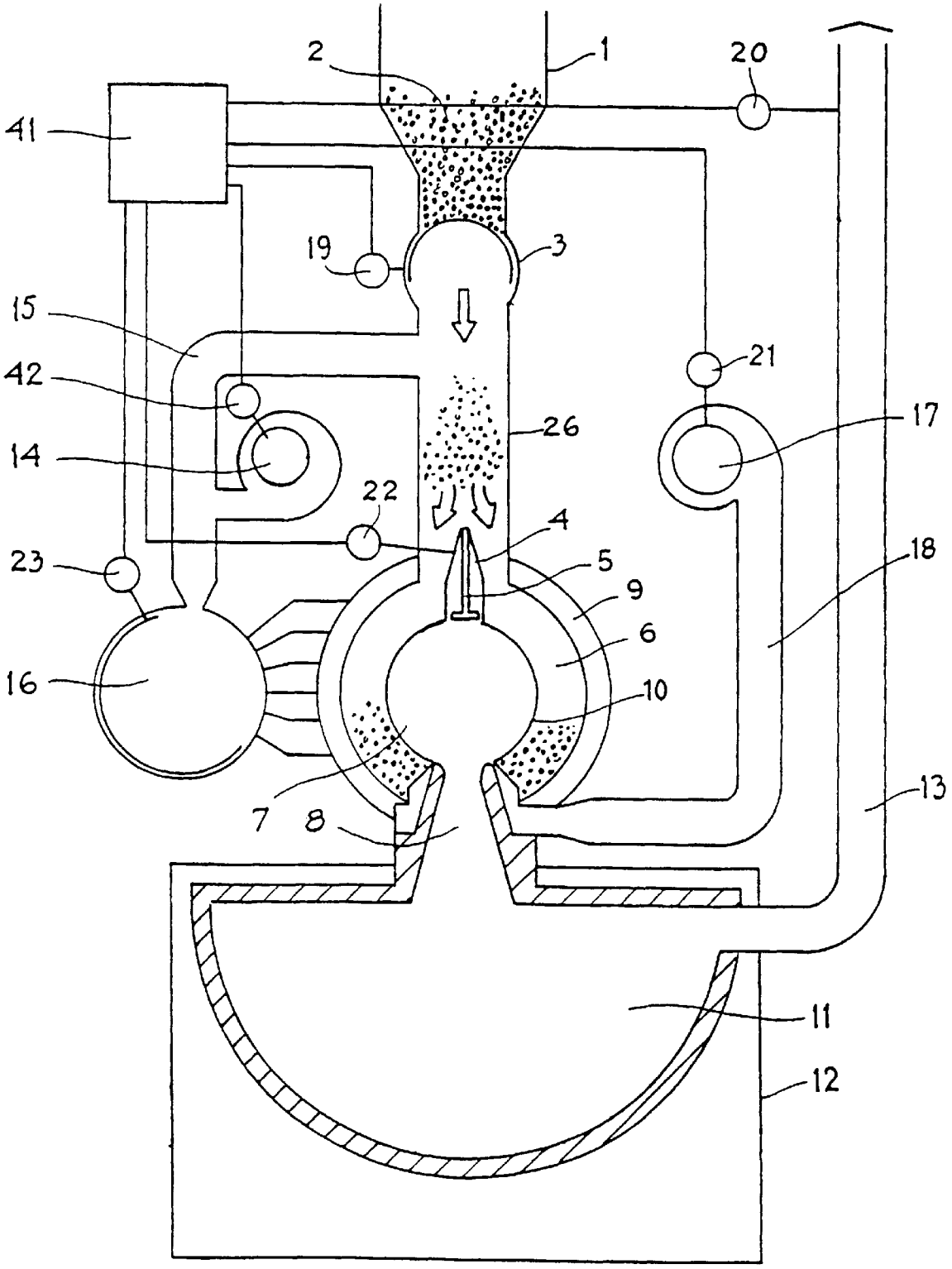
FIG. 1 shows a complete heating equipment.
Figure 2:
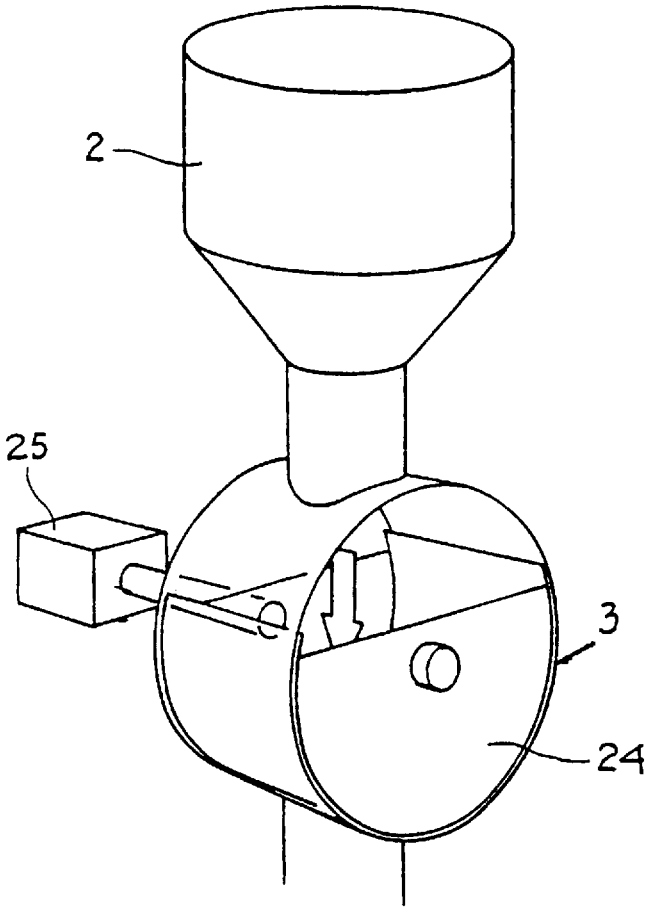
FIGS. 2 and 3 show the fuel bin with dosing device in two different situations.
Figure 3:
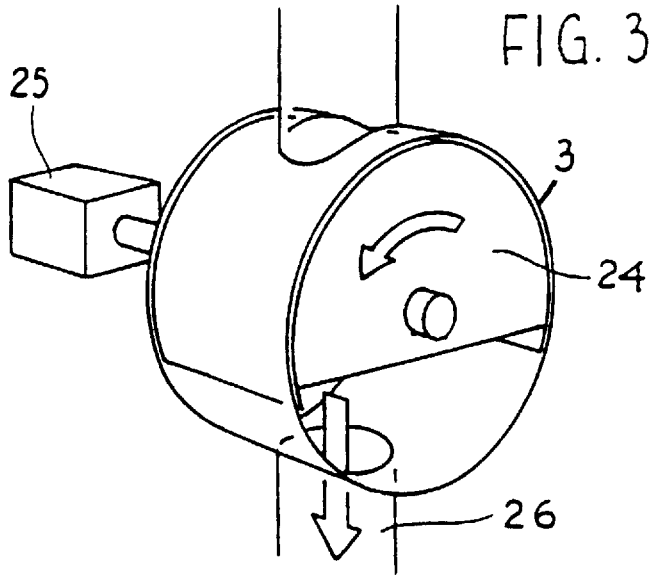
Figure 4:
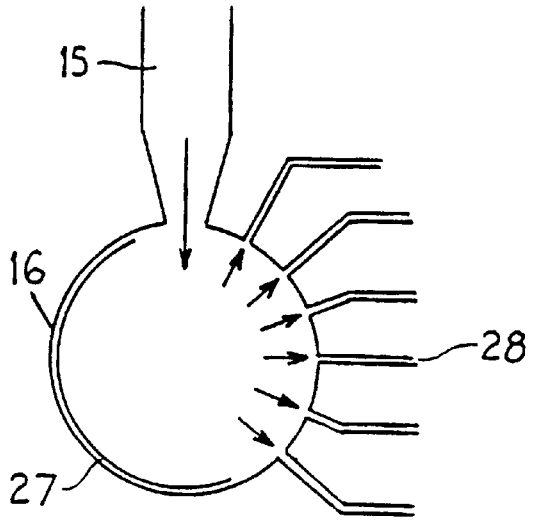
FIGS. 4, 5 and 6 show a distributing unit with control means in different situations.
Figure 5:
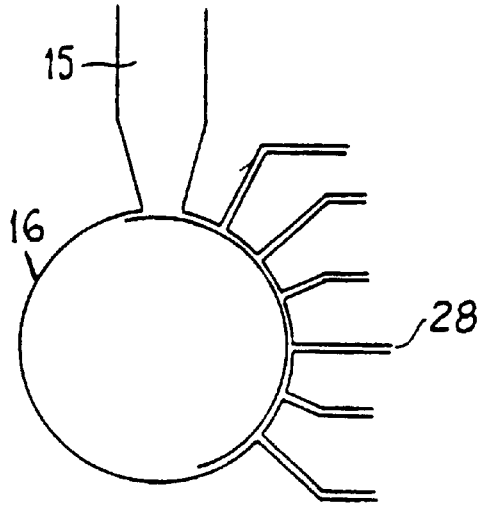
Figure 6:
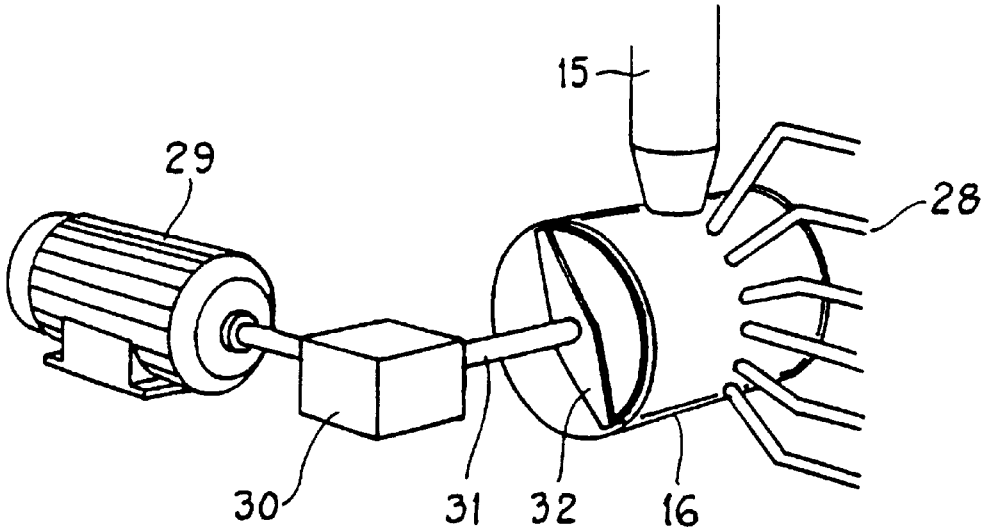
Figure 7:
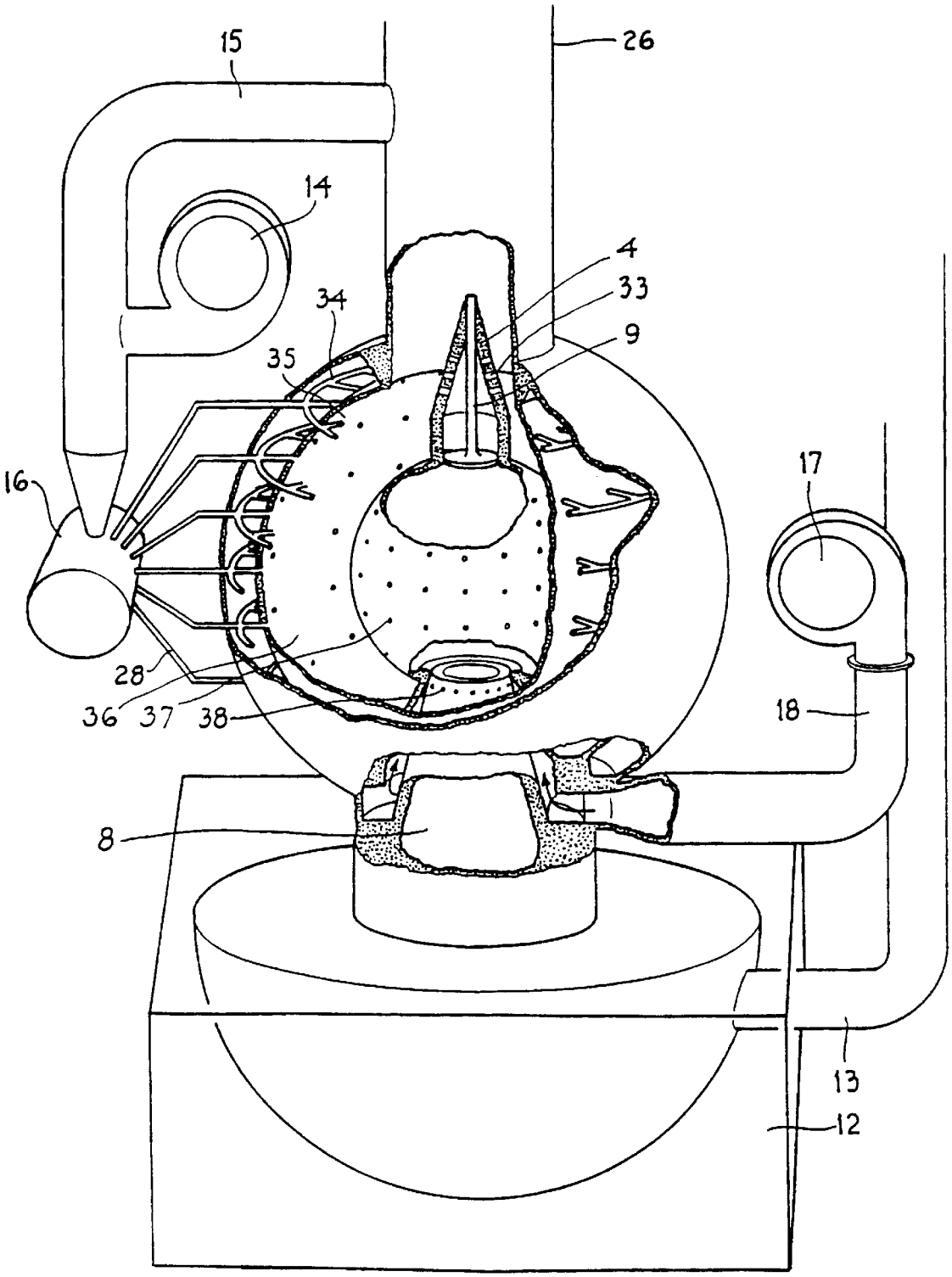
FIG. 7 shows more clearly the actual heating unit in FIG. 1, FIG. 8 also shows the heating unit, showing more clearly the medium-supply openings at the inlet end of the flame outlet.
Figure 8:
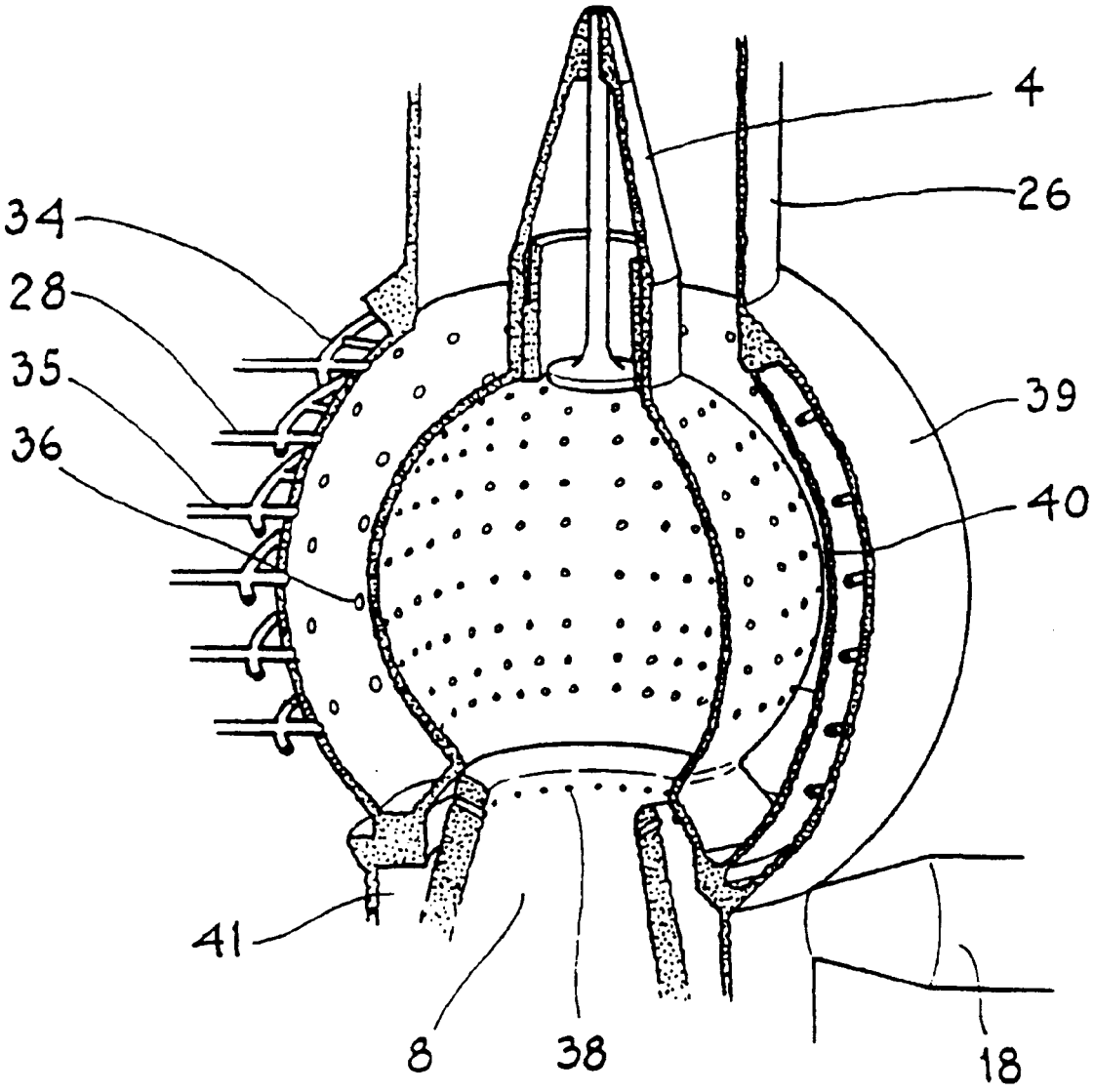

FIG. 1 shows a fuel bin 1 for pellets 2. The fuel bin should be closed to prevent it being ignited from below. The fuel bin emerges into a dosing device 3 which supplies the transport channel 26 with fuel. The fuel is supplied to a spherical space 6 surrounding a combustion area 7 which shall function as combustion chamber and is completely closed with the exception of a flame outlet 8. The outer wall 10 of the central area is perforated and forms one wall of the spherical space 6, the other wall being formed by a wall 9 consisting of an outer wall 39 and an inner wall 40. This inner wall is also perforated. From the flame outlet a heated medium is supplied to a space 11 arranged in a container 12 holding medium for absorbing heat. Water is a medium for absorbing heat and the container 12 can be connected to a system containing water or to some other system that requires energy. The space 11 communicates with a flue-gas outlet 13 which may be in the form of a chimney. A number of channels 38 are arranged at the inner end of the flame outlet and are connected to a channel 18 from a fan 17. Medium can thus be blown in towards the centre of the combustion area 7. The inner wall 40, provided with a number of perforations, is surrounded by a number of medium-transporting units in the form of pipes 34, each pipe forming a ring around the inner wall 40. The pipes are arranged from the upper end of the wall 40 to its lower end. Each pipe is connected to a perforation in the inner wall 40 by means of a pipe connection 35. Each pipe 34 is then connected to a pipe 28 leading to the distributing unit 16. The distributing unit 16 is in communication with a fan 14 which also communicates with the transport channel 26 running between the dosing device 3 and the spherical space 6. The distributing unit includes a heating device, not shown, for medium which passes the distributing unit. The distributing unit may be cylindrical and has a cylindrical partial wall 27 which can be turned by a motor 29 via a gear 30. The control wall is secured by an arm 32 and this arm can be turned by the motor 29 via a shaft 31 so that some of the pipes 28 can be closed off, as well as the supply of medium from the connection 15. FIGS. 7 and 8 show how medium is supplied from the fan 17 to the outlet openings 18 at the upper end of the flame outlet 8. Furthermore, the inner combustion chamber is provided with a valve 9 at its upper end. The valve is arranged in a unit 4 protruding from the combustion chamber, said unit being substantially conical and provided with passages 33 so that when the valve is open air can be supplied via the passages 33 to the combustion chamber 7.

As is clear from FIG. 1, control means are required if the heating equipment is to function optimally, and a control unit 41 is arranged for this purpose. The control unit 41 is provided with indicating means 19 at the dosing device, 20 at the chimney, 21 at the fan 17, 22 at the unit 4, 23 at the distributing unit 16 and 42 at the fan 14. An indicating means, not shown, is also provided in the combustion chamber 7, as well as indicating means in the space 11 and container 12.

The equipment described functions as follows: the bin 1 is filled with pellets 2 which are then supplied via the dosing device 3 and transport channel 26. When it reaches the unit 4 the material is split so that it is distributed uniformly in the combustion chamber 7. When the spherical space 6 is full the fuel is ignited, this being achieved by medium flowing from the fan 14 to the distributing unit 16 which contains a heating device, not shown, which heats the medium, the latter then being supplied to the spherical space 6. Once this is ignited the heating device is switched off and the control wall 16 is set in the desired position with the aid of the motor 29. If necessary the valve 5 may be opened so that air is supplied to the combustion chamber 7 from above. The combustion chamber can then be supplied with air from the nozzle end of the flame outlet through the channel openings 38. The equipment is trimmed by means of the control unit 41 so as to provide optimal energy, by influencing the various indicating devices.

Uncombusted particles can be returned to the centre of the combustion area by means of medium supplied through the channels 38. The dosing device 3 will operate intermittently during function of the heating equipment. The fuel in the spherical space 6 shall be allowed to burn out when the heating equipment is no longer to be used. The medium from the fan 14 can subsequently be used to blow the spherical space 6 around the combustion area 7 clean, and all ash is collected in an ash box arranged in the space 11.

Movable parts are avoided by the use of pipes forming rings as shown in FIG. 7 for the transport of medium, said rings receiving medium from the unit 16 and having branch pipes which supply the medium obtained to the perforations in the wall 40.

Naturally the combustion area 7 with its wall 10 may be allowed to rotate with the concentrically arranged wall 40, in which case no pipe system is required to the perforations. Instead a jet of medium can be directed towards the rotating unit and, since both the walls 10 and 40 rotate, the fuel in the spherical space 6 will be subjected to a continuous flow of medium.

With minor modifications, equipment of the present type can be adjusted to various systems designed to supply heat.

Figure 9:
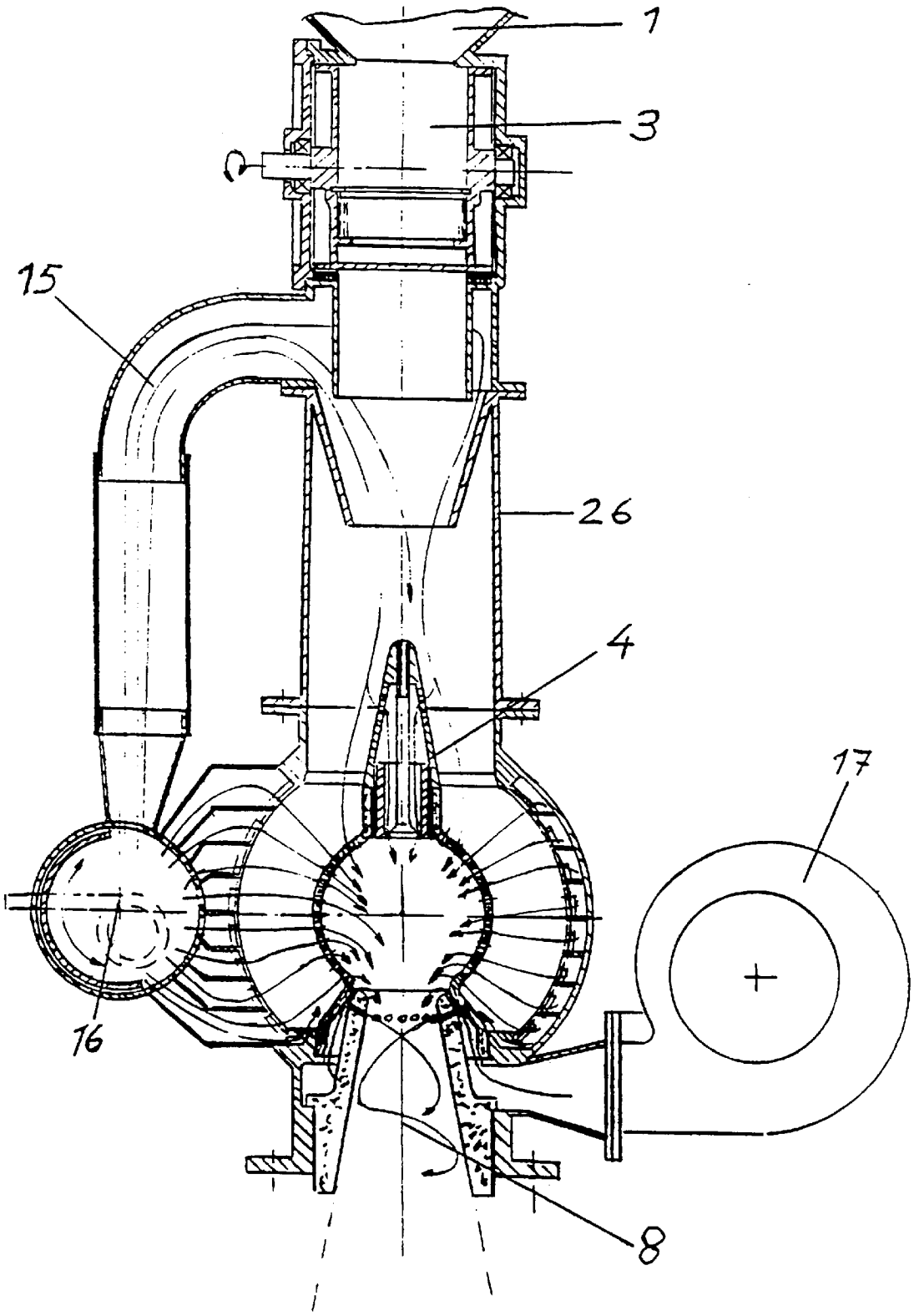
FIG. 9 is a modification of FIG. 1.

FIG. 9 differs from FIG. 1 in that the perforated outer wall of the fuel chamber is surrounded by pipes having rectangular cross section arranged one on top of the other.

Figure 10:
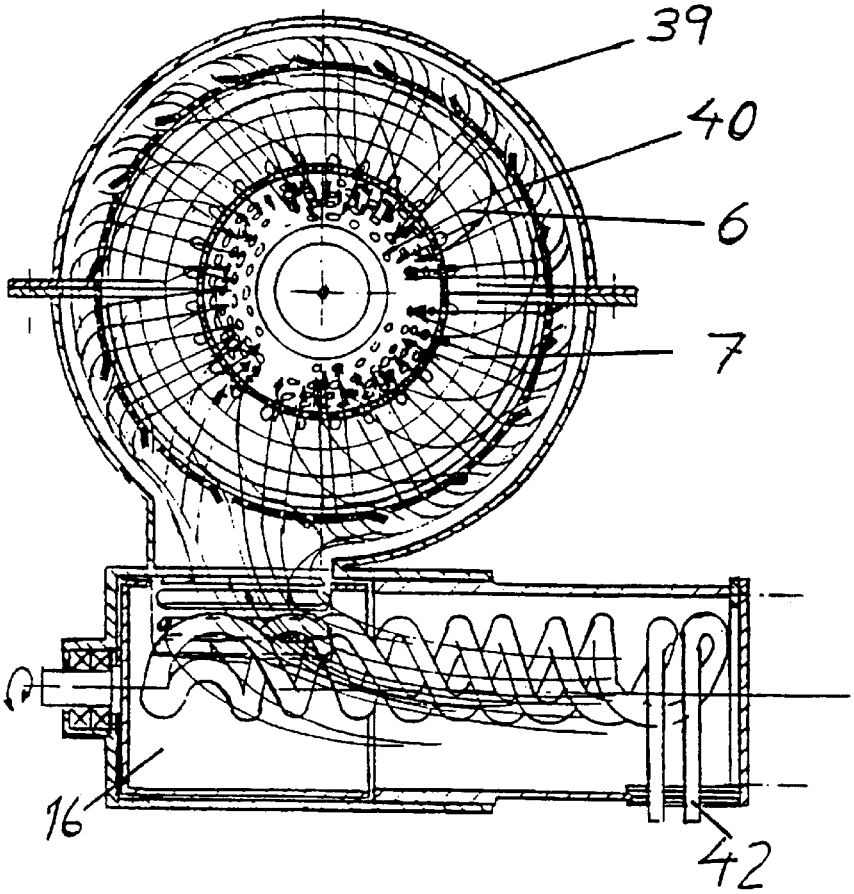
FIG. 10 is a modification of the units 6, 7 and 16.

FIG. 10 shows the central unit 7 and distributing unit 16 with a heating element 42.

Figure 11:
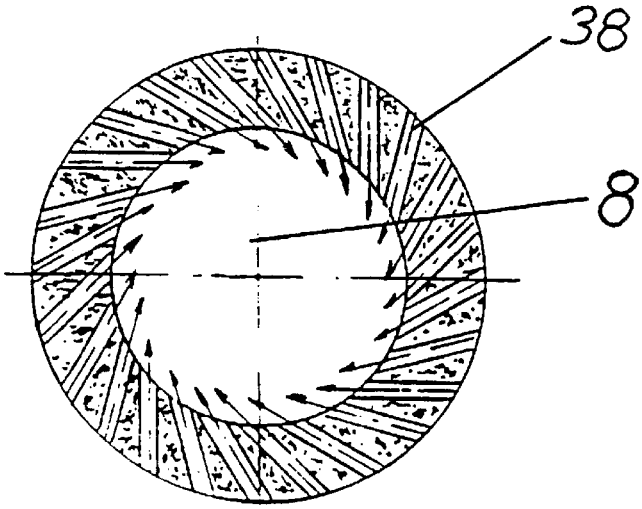
FIG. 11 shows a modification of the flame outlet 8.

FIG. 11 shows the flame outlet 8 provided with outflow channels 38 which, when medium is flowing through them, cause rotation of the flame when it passes the flame outlet.

Figure 12:
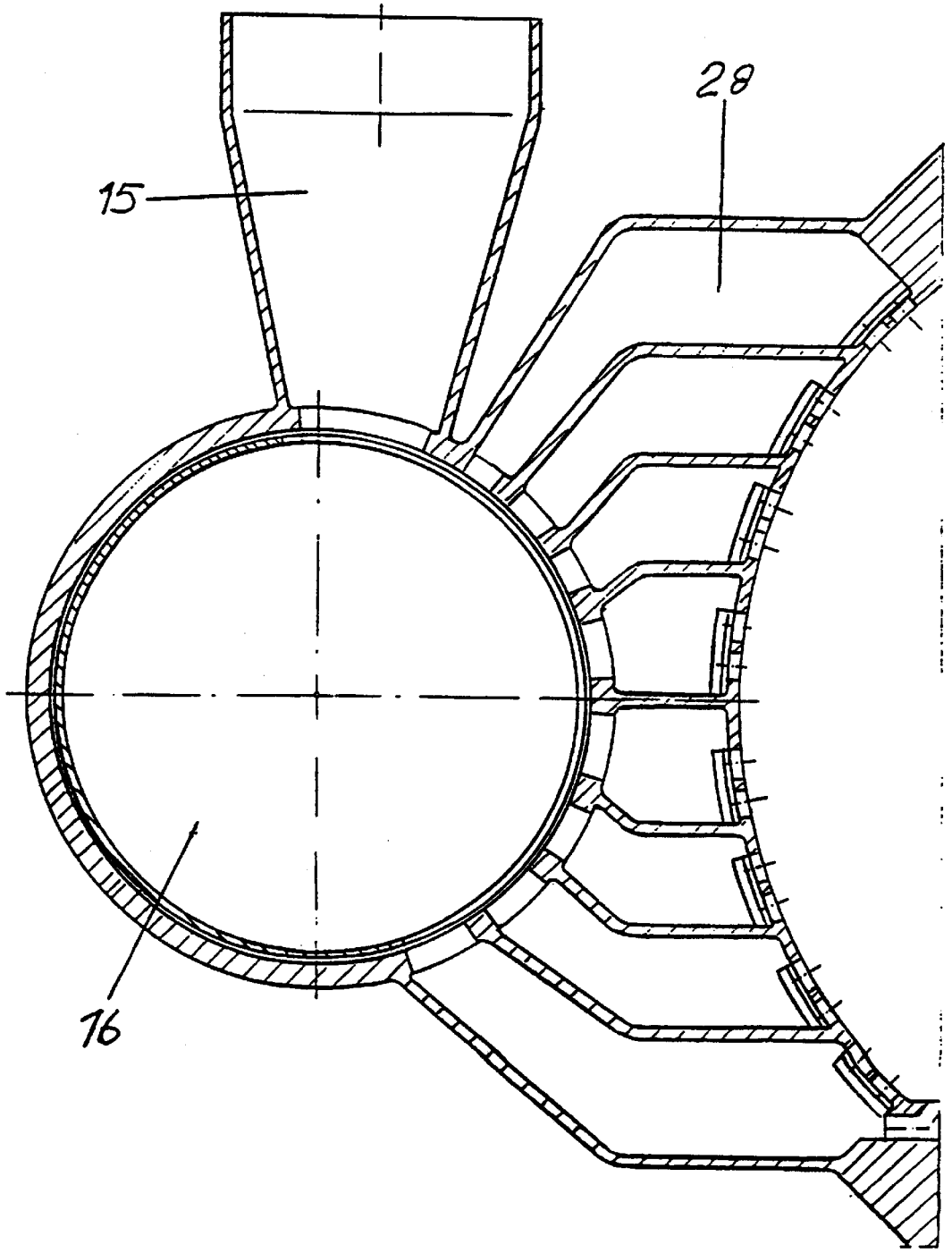
FIG. 12 shows a modification of the distributing unit 16.

FIG. 12 shows how the distributing unit 16 supplies medium to the fuel space via rectangular pipes.

What is claimed is:

1. Heating equipment for generating a seat of fire with the aid of solid fuel such as pellets ignited by heated gaseous medium such as air, characterized by a combustion area (7) which is surrounded by a first spherical wall (10) with a flame outlet (8), the surface of the combustion area (7) being perforated; by a space (6) constituted by said first wall (10) and a second spherical wall (40) situated outside the first wall (10), which space (6) is formed for the fuel, and the second wall (40) of the space (6) being completely perforated; and by a fan installation (14) which supplies the space (6) and the combustion area (7) with gaseous medium such air, the temperature of which can be regulated.

2. Heating equipment as claimed in claim 1, characterized in that both the combustion area (7) and the space (6) are rotatable about one and the same axis.

3. Heating equipment as claimed in claim 1, characterized in that both the perforated walls are concentric in relation to each other.

4. Heating equipment as claimed in claim 1, characterized in that the combustion area (7) is provided diametrically opposite the flame outlet (8) with an outwardly directed body (5) having two functions, one being to distribute the fuel to the space (6) and the other to supply gaseous medium to the combustion area (7) when necessary.

5. Heating equipment as claimed in claim 1, charaterized in that the first wall (10) and the second wall (40) are made of heat-resistant material such as ceramic which is resistant against high temperatures.

6. Heating equipment as claimed in claim 1, characterized by a fuel bin (1) for pellets (2), situated above the space (6) which has a closure at its supply end which can be opened and closed.

7. Heating equipment as claimed in claim 6, characterized in that a dosing device (3) is arranged at the lower end of the fuel bin (1).

8. Heating equipment as claimed in claim 7, characterized by a transport channel (26) between the dosing device (3) and the space (6), the fuel (2) preferably passing an outwardly directed body which distributes the fuel (2) to the space (6).

9. Heating equipment as claimed in claim 1, characterized by a fan (14) generating medium which passes the wall (40) with perforations (36) of the annular space and the wall (10) with perforations (37) of the space (6).

10. Heating equipment as claimed in claim 9, characterized in that the medium passes a distributing unit (16) before said two walls (10 and 40), which unit (16) distributes the quantity of medium supplied.

11. Heating equipment as claimed in claim 10, characterized in that before said two walls the medium passes a heat source, preferably located in the distributing unit (16), said heat source having the property of being able to heat the medium to such a temperature that it is capable of igniting the fuel (2) in the space (6).

12. Heating equipment as claimed in claim 10, characterized in that the distributing unit (16) is provided with a number of medium pipes (28) each of which is connected to an annular medium pipe (34) arranged around the wall (40) of the space (6), the annular pipes (34) being provided with connections (35) to the perforations (36) located within.

13. Heating equipment as claimed in claim 9, characterized in that the fan (14) also communicates with the transport channel (26).

14. Heating equipment as claimed in claim 13, characterized in that medium is supplied to the outwardly directed body (4) which is provided with a valve (5) which can be opened and closed to permit supply of medium to the combustion area (7).

15. Heating equipment as claimed in claim 9, characterized in that the outer wall (40) with perforations (36) of the annular space cooperates with a second outer wall spaced outside the wall (40) of the space, said walls together forming a closed space with the exception of a supply opening for medium which is spread in the closed spaces and passes through the perforations.

16. Heating equipment as claimed in claim 1, characterized in that the combustion area (7) is in communication with a space (11) for the medium from the combustion area (7) via the flame outlet (8), said first-mentioned spaced (11) transferring heat to a heat-absorbing medium such as water, arranged in a container (12) from which the heat obtained is conducted to a consumer such as heating equipment in which the heat is waterborne.

17. Heating equipment as claimed in claim 16, characterized in that space (11) for receipt of combustion medium is connected to a flue gas outlet (13).

18. Heating equipment as claimed in claim 1, characterized in that the orifice of the flame outlet (8) is connected to a medium fan (17) for introducing uncombusted particles into the combustion area (7).

19. Heating equipment as claimed in claim 1, characterized in that said medium fan (17) is provided with outlets through channels (38) at the inner end of the flame outlet (8) arranged in such a way that the medium forces rotation of the flame and preferably increases the through-flow rate of the flame.

* * * * *